US011420791B2

(12) United States Patent
Sostmann

(10) Patent No.: US 11,420,791 B2
(45) Date of Patent: Aug. 23, 2022

(54) PLASTIC PALLET WITH HANDLE

(71) Applicant: Georg Utz Holding AG, Bremgarten (CH)

(72) Inventor: Rüdiger Sostmann, Lingen (DE)

(73) Assignee: Georg Utz Holding AG, Bremgarten (CH)

( * ) Notice: Subject to any disclaimer, the term of this patent is extended or adjusted under 35 U.S.C. 154(b) by 0 days.

(21) Appl. No.: 17/278,877

(22) PCT Filed: Sep. 16, 2019

(86) PCT No.: PCT/IB2019/057773

§ 371 (c)(1),
(2) Date: Mar. 23, 2021

(87) PCT Pub. No.: WO2020/065437

PCT Pub. Date: Apr. 2, 2020

(65) Prior Publication Data

US 2022/0041330 A1 Feb. 10, 2022

(30) Foreign Application Priority Data

Sep. 26, 2018 (CH) ..... 01169/18

(51) Int. Cl.
*B65D 19/38* (2006.01)
*B65D 19/00* (2006.01)

(52) U.S. Cl.
CPC ..... *B65D 19/38* (2013.01); *B65D 19/0016* (2013.01); *B65D 2519/00034* (2013.01);
(Continued)

(58) Field of Classification Search
CPC ..... B65D 2519/00791; B65D 2519/00034; B65D 2519/00069; B65D 2519/00139;
(Continued)

(56) References Cited

U.S. PATENT DOCUMENTS 5,687,652 A * 11/1997 Ruma ..... B65D 19/0012 108/57.25
5,778,801 A * 7/1998 Delacour ..... B65D 19/0034 108/57.25
(Continued)

FOREIGN PATENT DOCUMENTS

CN 107472639 A 12/2017
EP 0 979 778 A2 2/2000
(Continued)

OTHER PUBLICATIONS

International Search Report for International Application No. PCT/IB2019/057773 dated Nov. 21, 2019.
(Continued)

*Primary Examiner* — Jose V Chen
(74) *Attorney, Agent, or Firm* — McCormick, Paulding & Huber PLLC

(57) ABSTRACT

The invention relates to a plastic pallet having an underside provided with skids and an upper side, wherein one skid runs along the centre of the plastic pallet and the skid along the centre has a handle which may be gripped from the underside of the pallet. The handle is preferably arranged on the underside of the central skid preferably parallel to the surface of the upper side and preferably along the central longitudinal axis of the central skid.

15 Claims, 9 Drawing Sheets

(52) U.S. Cl.
CPC ..... *B65D 2519/00069* (2013.01); *B65D 2519/00129* (2013.01); *B65D 2519/00268* (2013.01); *B65D 2519/00288* (2013.01); *B65D 2519/00318* (2013.01); *B65D 2519/00333* (2013.01); *B65D 2519/00407* (2013.01); *B65D 2519/00442* (2013.01); *B65D 2519/00791* (2013.01)

(58) Field of Classification Search
CPC ..... B65D 2519/00268; B65D 2519/00288; B65D 2519/00318; B65D 19/38
USPC ..... 108/57.25
See application file for complete search history.

(56) References Cited

U.S. PATENT DOCUMENTS

| | | | | |
|---|---|---|---|---|
| 6,357,366 | B1 * | 3/2002 | Frankenberg | B65D 19/0026 108/57.25 |
| 7,856,932 | B2 | 12/2010 | Stahl et al. | |
| 7,908,980 | B2 * | 3/2011 | Schmidt | B65D 77/0466 108/51.11 |
| 8,695,512 | B2 | 4/2014 | Nevo et al. | |
| 9,611,071 | B2 * | 4/2017 | Baltz | B65D 19/44 |
| 10,589,897 | B1 * | 3/2020 | Shawaf | B65D 19/0038 |
| 11,040,799 | B1 * | 6/2021 | Sommer | B65D 19/0018 |
| 2003/0061974 | A1 * | 4/2003 | Smyers | B65D 19/0012 108/57.33 |
| 2008/0141912 | A1 * | 6/2008 | Valentinsson | B65D 19/0014 108/51.11 |
| 2011/0120353 | A1 * | 5/2011 | Jensen | B65D 19/0073 108/57.25 |
| 2012/0160734 | A1 * | 6/2012 | Linares | B65D 19/0028 206/386 |
| 2013/0160680 | A1 * | 6/2013 | Ten Bok | B29C 69/02 264/41 |
| 2016/0368659 | A1 * | 12/2016 | Bastian, II | B65D 19/0014 |
| 2017/0297765 | A1 | 10/2017 | Guerry et al. | |
| 2019/0308769 | A1 * | 10/2019 | Apps | B65D 19/0016 |
| 2019/0337673 | A1 * | 11/2019 | O'Connell | B65D 19/0018 |
| 2020/0148417 | A1 * | 5/2020 | Daubenspeck | B62B 3/16 |
| 2021/0039830 | A1 * | 2/2021 | Kalinowski | B65D 19/0018 |

FOREIGN PATENT DOCUMENTS

| | | | | |
|---|---|---|---|---|
| EP | 2 067 709 | A2 | 6/2009 | |
| EP | 2 877 408 | B2 | 1/2018 | |
| EP | 3587295 | A1 * | 1/2020 | B65D 19/0002 |
| EP | 3599184 | A1 * | 1/2020 | B29C 41/04 |
| JP | 2000-142695 | A | 5/2000 | |
| JP | 2008-056303 | A | 3/2008 | |
| WO | 0078620 | A1 | 12/2000 | |

OTHER PUBLICATIONS

Written Opinion for International Application No. PCT/IB2019/057773 dated Nov. 21, 2019.

* cited by examiner

PLASTIC PALLET WITH HANDLE

CROSS-REFERENCE TO RELATED APPLICATIONS

This application is a National Stage application of International Patent Application No. PCT/IB2019/057773, filed on Sep. 16, 2019, which claims priority to Swiss Patent Application No. CH 01169/18, filed on Sep. 26, 2018, each of which is hereby incorporated by reference in its entirety.

TECHNICAL FIELD OF THE INVENTION

The invention relates to a plastic pallet having skids.

BACKGROUND OF THE INVENTION

Plastic pallets with a handle are known, for example, from US2017297765A1. Therein is described a pallet having a plurality of feet and a plurality of handles that can be gripped from the lower side of the pallet. The handles comprise a through-hole having side walls and having an entrance opening extending perpendicular to the surface of the pallet and parallel to the short side of the pallet. The handles are located outside the center of the pallet and outside the feet.

Furthermore, EP2877408 describes a pallet with four feet, an upper side and a lower side, wherein the upper side has a hand access hoe in the center which extends parallel to the short side of the pallet. This allows dripping the hole from the upper side and the pallet to be carried. The pallets are stackable in that the feet have an opening and the feet of a first pallet engage the opening of the feet of a second pallet stacked thereon.

In addition, pallets with handles on the peripheral sides of the pallet or in the lateral area of the surface of the pallet are known from US7856932, EP2067709 or WO0078620, Pallets with handles in the lateral area or on the peripheral sides of the pallet have the disadvantage that such pallets usually have to be carried with two hands.

SUMMARY OF THE INVENTION

The present invention is now based on the object of specifying a plastic pallet having skids, which allows optimized easy handling for transport with one hand and makes it possible to carry the dean upper side of the pallet towards the body.

DETAILED DESCRIPTION OF THE INVENTION

This object is solved by a plastic pallet having a lower side provided with skids and an upper side, wherein one skid runs along the center of the plastic Pallet and the skid along the center of the pallet has a handle which can be gripped from the lower side of the pallet. The skid along the center of the plastic pallet is also referred to as the central skid, regardless of how many skids the pallet has. Preferably, the plastic pallet has three skids, preferably three longitudinal skids.

However, it is also possible that the plastic pallet has two skids and three feet, or that it has three transverse skids, or that it has more than three skids, for example five skids.

Preferably, the handle is arranged in the center of the central skid, relative to the length and width of the pallet, preferably along the central longitudinal axis of the central skid. Particularly preferably, the handle is located at the geometric center of the pallet, as close as possible to or at the center of gravity of the pallet. This allows heavier pallets weighing 20 kilograms or more to be carried with one hand.

However, the arrangement of the handle in the central skid with respect to the height between the upper side of the pallet and the lower side of the skid is variable. Preferably, the handle is located on the lower side of the central skid, as close as possible to the surface that would be in contact with the floor. This allows the easiest and most ergonomic access to the handle from the lower side of the pallet.

The term "can be dripped from the lower side" is understood to mean that the handle of the pallet can be gripped either from below or from the side of the pallet. In contrast, the handle cannot be gripped from the upper side of the pallet.

The handle is preferably of elongated design. The orientation of the handle extends ideally parallel to the surface of the upper side, preferably along the central longitudinal axis of the central skid. In this embodiment, a cavity for fingers is provided between the handle and the upper side of the plastic pallet. Preferably, the opening to the cavity is located in the lower surface of the central skid, in the area of the surface that would be in contact with the floor.

In another embodiment, the lower side of the central skid is continuous and the handle is parallel to the upper side of the pallet and on a plane between the lower side of the central skid and the upper side of the pallet. In this embodiment, the opening to the cavity for fingers is preferably in the side wall of the central skid.

In yet another embodiment, the handle is arranged perpendicular to the longitudinal direction of the central skid and perpendicular to the surface of the upper side of the pallet. In this embodiment, the opening to the cavity for fingers is also preferably located in the side wall of the central skid.

The opening in the side wall of the central skid allows the handle to be gripped from the side of the pallet, optionally through additional openings in the outer skid, which allows the pallet to be removed from the side of a stack. The side of the pallet also belongs to the lower side.

The elongated handle preferably has a substantially rectangular, square, U-shaped or triangular cross-section with preferably slightly rounded corners. The slightly rounded corners provide a high degree of comfort for the hand. The elongated handle may also have a round or elliptical cross-section and may, for example, be formed as a circular cylinder. In a further embodiment, the handle has a round or elliptical shape, for example in the form of a sphere, a knob or an ellipsoid.

The upper side of the plastic pallet preferably has a continuous closed surface. This is possible because the handle is located in the skid on the lower side of the pallet. The closed surface of the upper side may be provided with a substantially smooth surface so that the pallet is easy to clean and does not provide any protrusions for dirt or bacteria, which makes it suitable for use in hygienic and clean room areas.

The plastic pallets are made of a durable and resilient material, preferably of one or more thermoplastics. For example, the thermoplastic material contains polyethylene or polypropylene or blends thereof, in addition, the plastic pallet may have reinforcements in various profiles, for example steel profiles, especially steel pipes. The reinforcements for strengthening the plastic pallets and increasing the load capacity may be arranged in any desired manner. For example, reinforcing tubes may be arranged along the sides of the pallet, along the skids of the pallet, or along all four sides.

The plastic pallet according to the invention has the great advantage that due to the handle on the lower side, the flat upper side rests against the body when carried. The upper side is usually cleaner than the lower side with the skids. This is a great advantage over pallets with handles on the upper side of the pallet, where either an edge or the dirty lower side of the pallet is pressed against the body with the feet or skids when carrying, which is uncomfortable and requires more force. Carrying the plastic pallet according to the invention, on the other hand, is comfortable due to the handle on the lower side and requires less force. The position of the handle in the central skid makes it possible to carry the pallet with only one hand. Due to this special arrangement of the handle, even smaller people can carry the pallet.

Another advantage of the present invention is that the handle is located near or at the center of gravity of the pallet, which also simplifies carrying the pallet.

In a further embodiment, there is also an advantage in that the handle can be grasped from the side of the pallet through an opening in the side wall of the central skid, and lateral removal of the pallet from a stack is possible.

Combinations of two or more of the above embodiments and variants are conceivable and claimed.

Further advantages of the invention follow from the following description, in which the invention is explained in more detail by means of exemplary embodiments shown in the schematic drawings.

BRIEF DESCRIPTION OF THE DRAWINGS

The figures show as follows.

In the figures, the same reference numerals are used for the same elements in each case, and explanations of a particular reference numeral apply to all figures unless explicitly stated otherwise.

DESCRIPTION OF THE PREFERRED EMBODIMENTS

Figure 1:
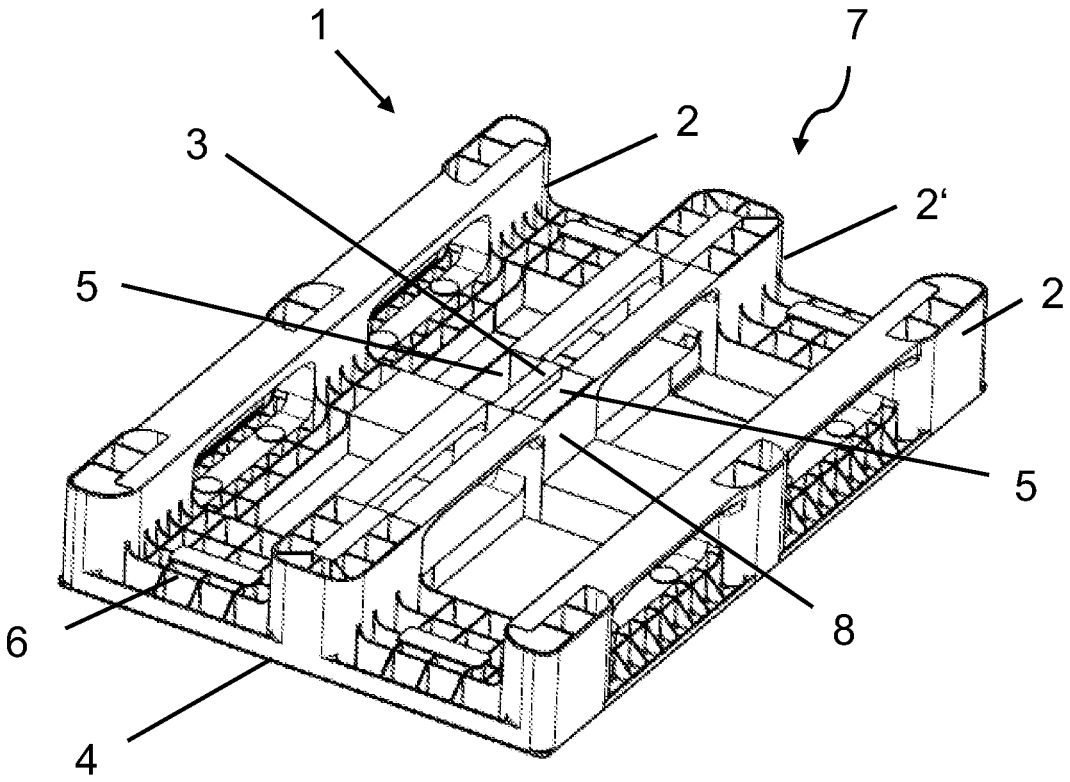
FIG. 1 shows a plastic pallet with handle in perspective view of the lower side of the pallet.

FIG. 1 shows a plastic pallet 1 having three skids 2, 2' on the lower side 7 of the pallet 1, and an upper side 4, wherein the central skid 2' has a handle 3. In addition, cavities 5 are provided in the central skid 2 between the handle 3 and the upper side 4, and between the handle 3 and the side walls 8 of the central skid 2', These cavities provide enough space to grasp the handle with the hand or fingers or, depending on the position of the hand, to completely enclose the handle.

The handle 3 is of elongated design with slightly rounded edges and arranged on the lower side of the central skid 2'. The orientation of the handle 3 extends parallel to the surface of the upper side and along the central longitudinal axis of the central skid 2'. Moreover, the handle 3 is arranged in the center of the central skid at the geometric center of the pallet and as close as possible to the center of gravity of the pallet, close to the contact surface of the skid with the ground. This, arrangement allows for the easiest possible access to the handle, and the handle can be easily grasped from the lower side 7 of the pallet 1.

The lower side 7 of the plastic pallet 1 has a ribbed structure 5 with cavities to provide mechanical stability and great reductions in weight.

Figure 2A:
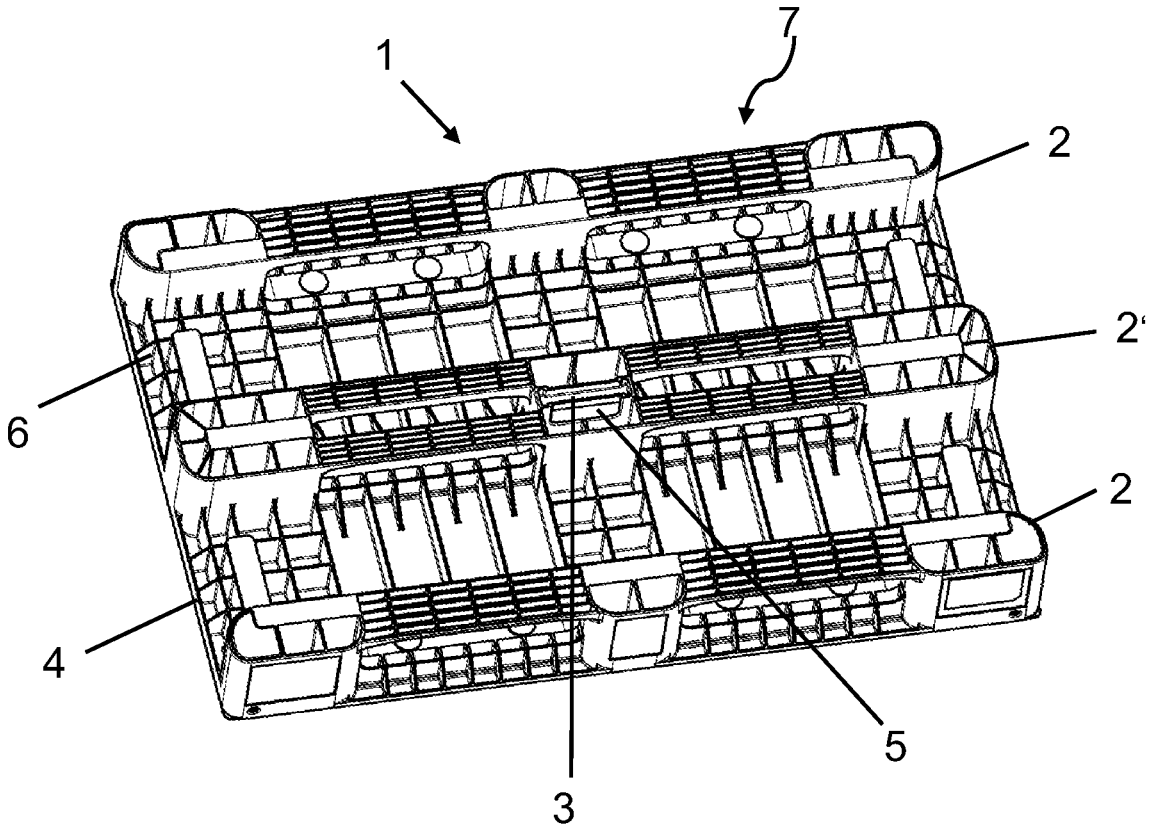
FIG. 2A shows the plastic pallet with handle in a further perspective view obliquely from below.

FIG. 2A shows a plastic pallet 1 as described in FIG. 1 from a different perspective and with a different rib structure 6 on the lower side 7.

Figure 2B:
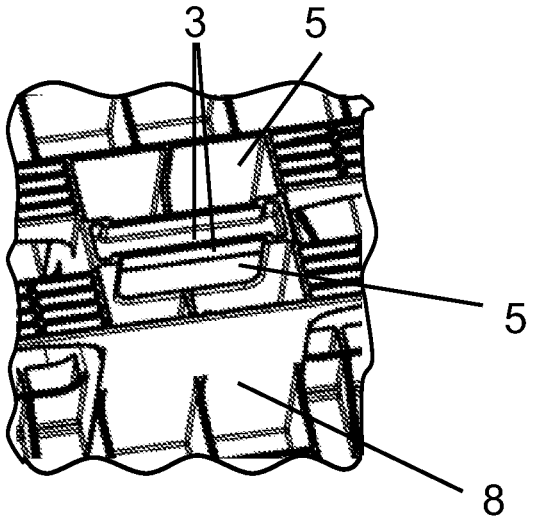
FIG. 2B shows a detailed view of the handle of the plastic pallet of FIG. 2A.

FIG. 2B shows a section of FIG. 2A with the handle 3 and the cavities 5 at the side of the handle 3 between the handle 3 and the side walls 8 of the central skid 2' and the cavity 5 between the handle 3 and the upper side 4 (not shown) of the pallet 1.

Figure 3:
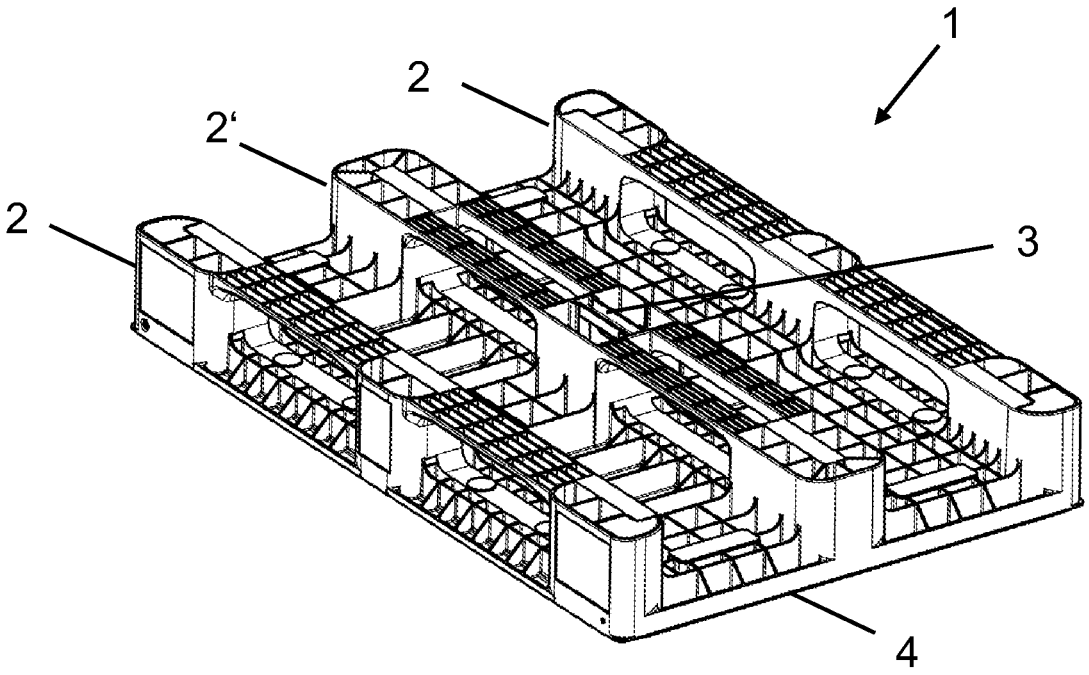
FIG. 3 shows another perspective view of the plastic pallet with handle from below.
Figure 4:
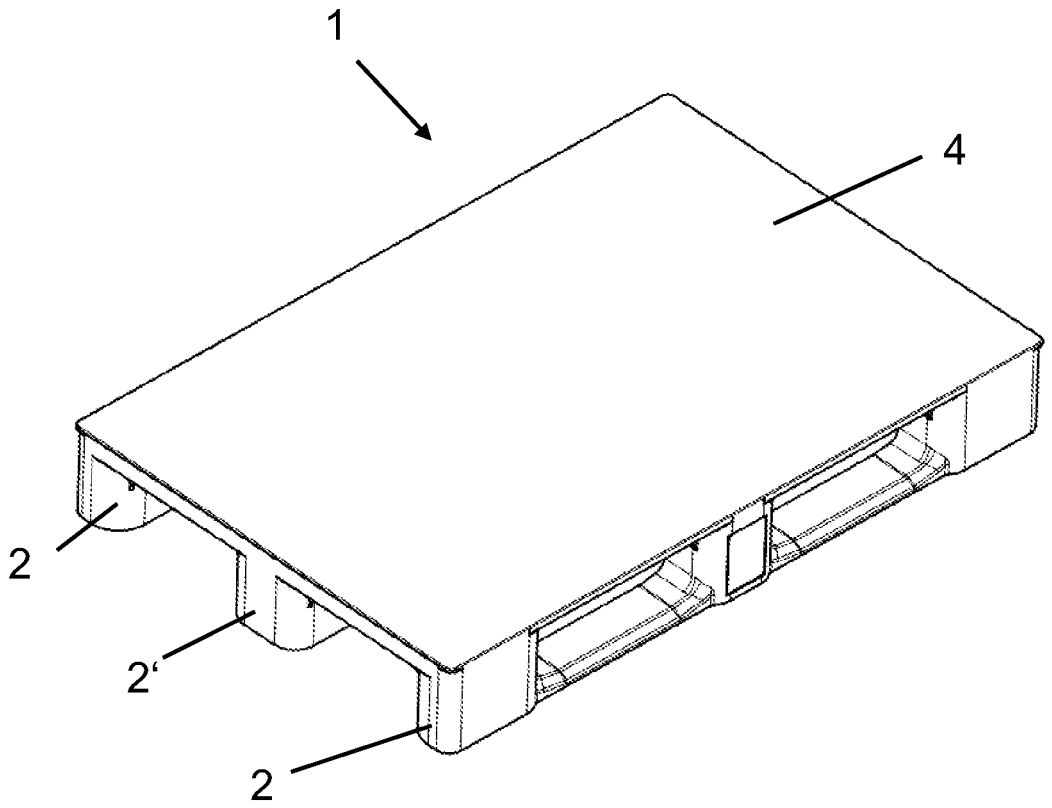
FIG. 4 shows the plastic pallet with handle in perspective view from above.

FIG. 3 shows the plastic pallet as described in FIG. 2A in a further perspective view, FIG. 4 shows a perspective view on the upper side 4 of the plastic pallet 1 with the three skids 2, 2'. The upper side 4 has a closed surface.

Figure 5:
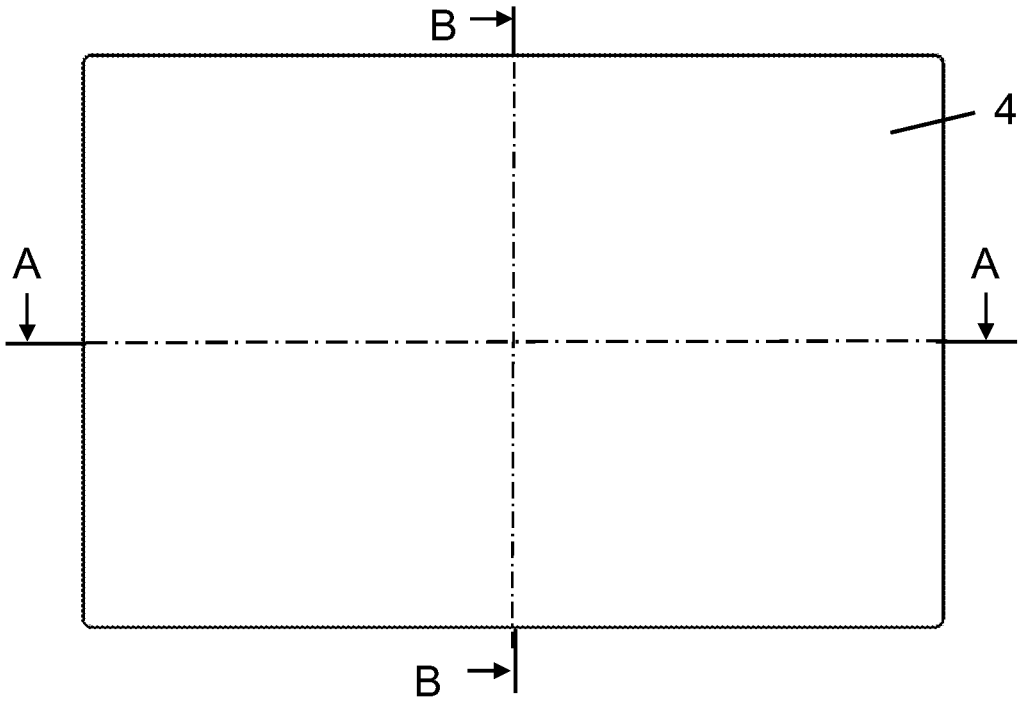
FIG. 5 shows the plastic pallet of FIG. 4 in a top view of the upper side.

FIG. 5 shows the upper side 4 of the plastic pallet 1, as shown in FIG. 4, with a closed surface. In addition, the longitudinal axis along line A-A and the transverse axis along line B-B are drawn.

Figure 6:
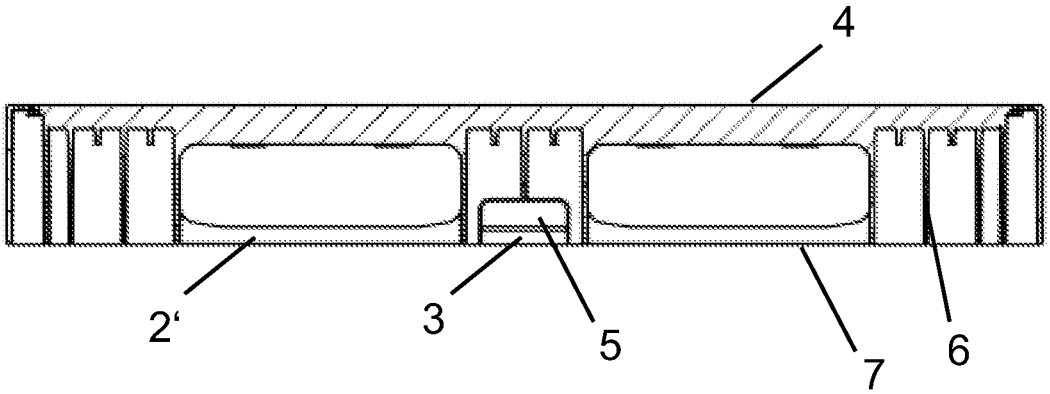
FIG. 6 shows a cross-section through the central longitudinal axis of the central skid of the plastic pallet along line A-A of FIG. 5.

FIG. 6 shows a cross-section through the central longitudinal axis A-A of the central skid 2' of the plastic pallet 1 of FIG. 5. The elongated handle 3 is arranged in the middle of the central skid 2' along the central longitudinal axis A-A on the lower side 7 of the pallet 1. The cross-section shows the cavity 5 between the handle 3 and the upper side 4 of the pallet 1. In addition, the rib structures 6 and the interposed cavities are evident.

Figure 7:
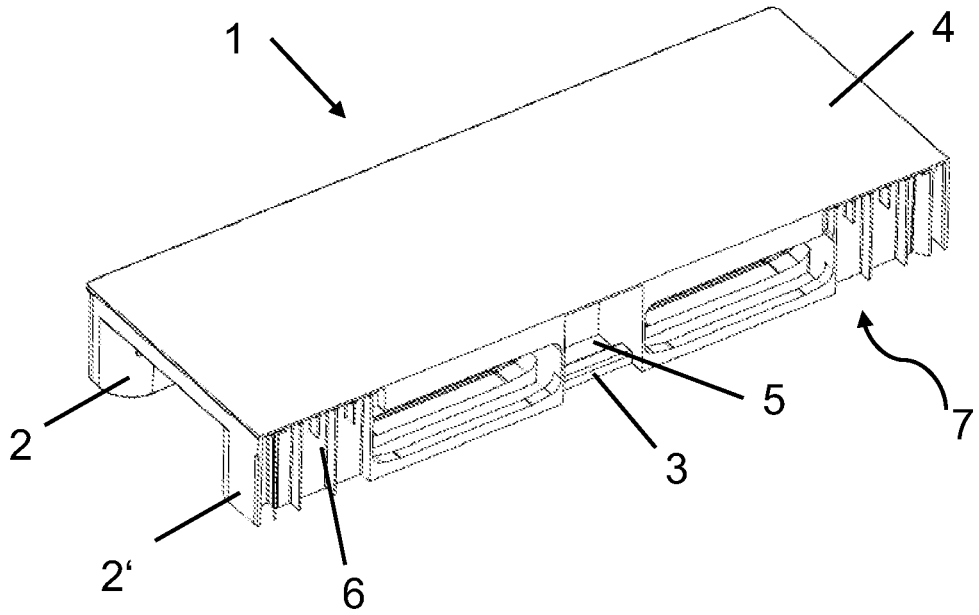
FIG. 7 shows a cross-section through the central longitudinal axis of the central skid along line A-A of FIG. 5 through the plastic pallet.

FIG. 7 shows a cross-section through the central longitudinal axis A-A of the pallet 1 of FIG. 5 as described in FIG. 6 in a perspective view. In addition to FIG. 6, an outer skid 2 can be seen here in addition to the central skid 2'.

Figure 8:
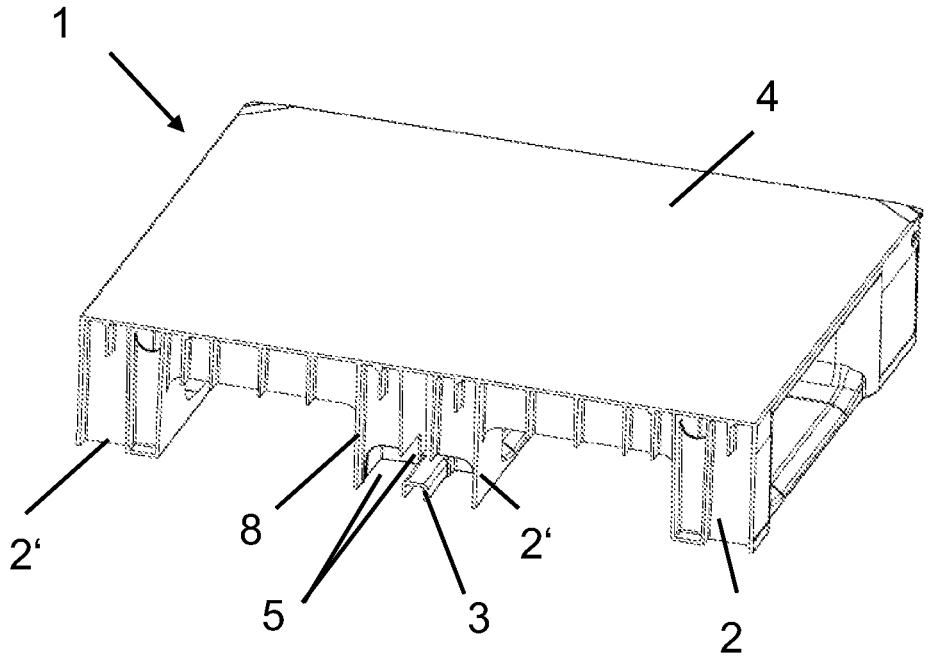
FIG. 8 shows a cross-section along line B-B of FIG. 5 through the plastic pallet.

FIG. 8 shows a cross-section through the central transverse axis B-B of the pallet 1 of FIG. 5 in a perspective view. The handle 3 in the center of the central skid 2' has a U-shaped cross-section with the opening of the U facing downward. The two outer skids 2 and the cavities 5 between the handle 3 and the side walls 8 of the central skid 2' and between the handle 3 and the upper side 4 of the pallet 1 are also shown. These cavities 5 provide sufficient space to grip the handle in an ergonomic manner.

Figure 9:
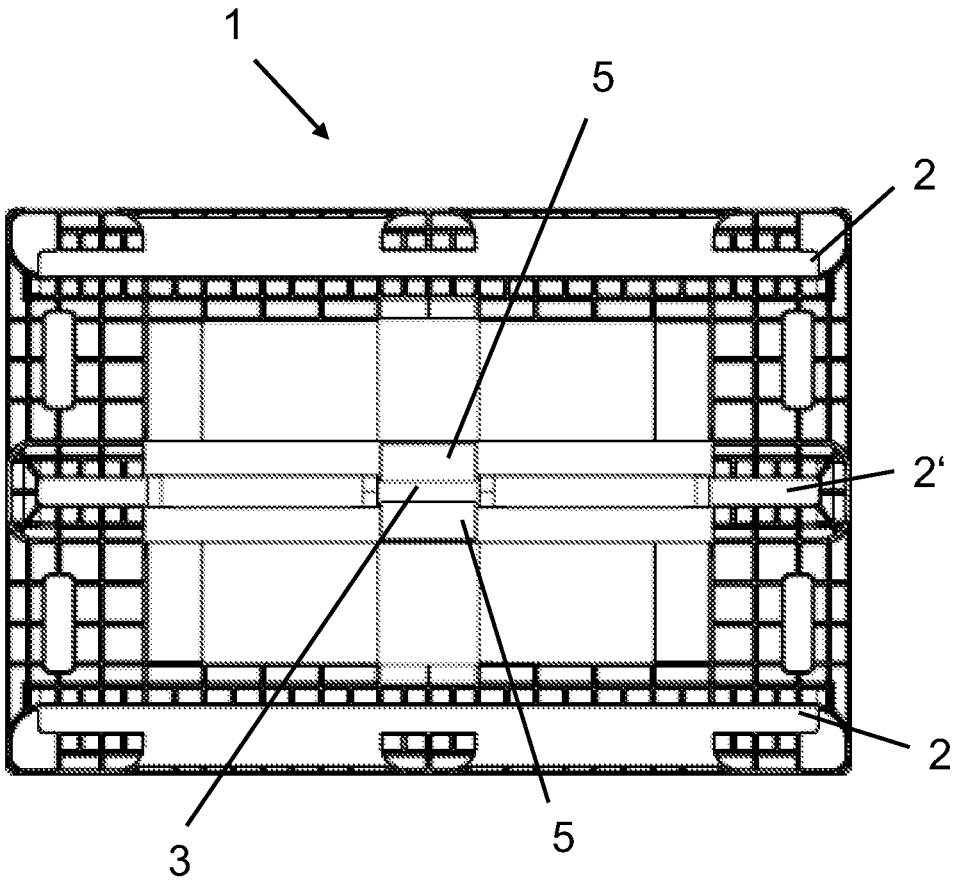
FIG. 9 shows the plastic pallet in a view from below on the lower side with skids.

FIG. 9 shows a bottom view of the lower side 7 of the plastic pallet 1 with the two outer skids 2 and the central skid 2', the elongated handle 3 and the rib structure 6 of the pallet 1. The alignment of the elongated handle 3 along the central longitudinal axis of the central skid 2' can be seen.

Figure 10:
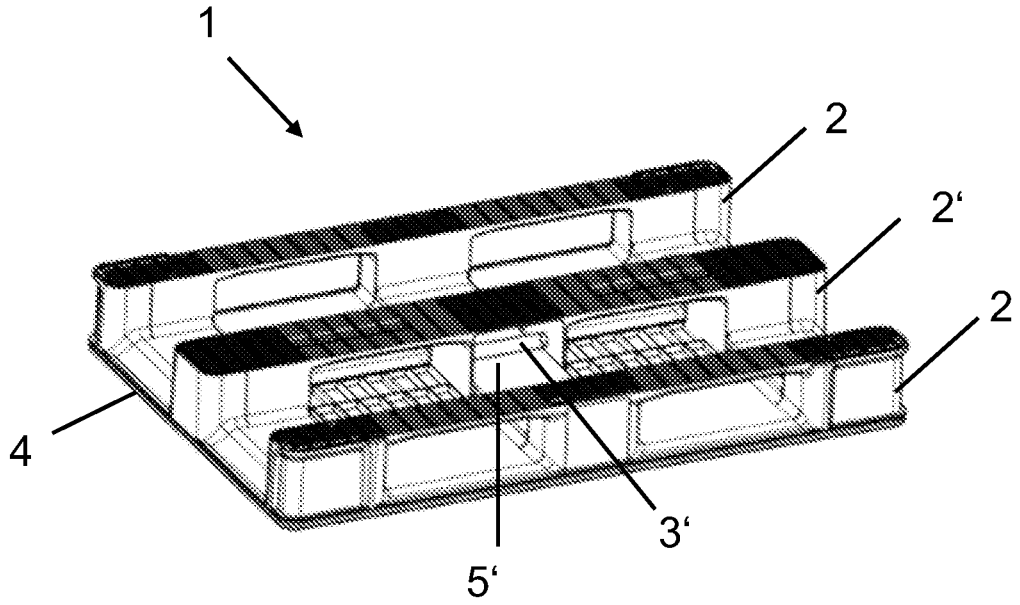
FIG. 10 shows the plastic pallet with a variant of the handle in perspective view from below.
Figure 11:
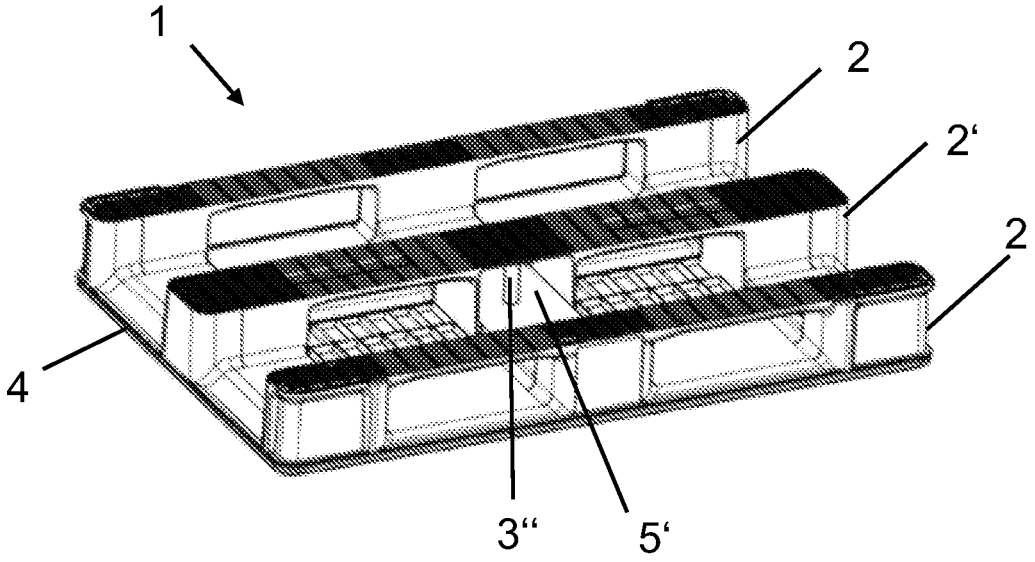
FIG. 11 shows the plastic pallet with a further variant of the handle in perspective view from below.

FIGS. 10 and 11 show two further variants of the handle 3', 3". The handle 3', 3" has a cylindrical shape and is arranged in the center of the central skid 2'.

In FIG. 10, the elongated handle 3' is arranged parallel to the surface 4 along the central longitudinal axis in the direction of the central on skid 2'. Moreover, the circular cylindrical handle 3' is arranged on a pane between the upper surface 4 of the pallet and the lower side of the skid 2', and the lower surface of the lower side of the central skid 2 is continuous. An opening to a cavity 5' for fingers is provided in the side wall of the central skid 2' for easier access to the handle 3'. In this variant, the handle 3' can be gripped through the skids 2, 2' from the side of the lower side of the pallet 1, which enables lateral removal of the pallet 1 from a stack.

In FIG. 11, the elongated handle 3" is arranged perpendicular to the longitudinal direction of the central skid 2' and perpendicular to the upper side 4 of the pallet 1, wherein the circular-cylindrical handle 3' is arranged between the upper side 4 of the pallet 1 and the lower side of the skid 2', and the lower surface of the lower side of the central skid 2' is continuous. But in this case too, the handle 3" is located in the geometric center as close as possible or in the center of gravity of the pallet 1. In the side wall of the central skid 2', an opening to a cavity 5 for fingers is provided to facilitate access to the handle 3". In this variant, the handle 3" can also be gripped through the skids 2, 2' from the side of the lower side of the pallet 1, which allows the pallet 1 to be removed from a stack from the side.

Figure 12:
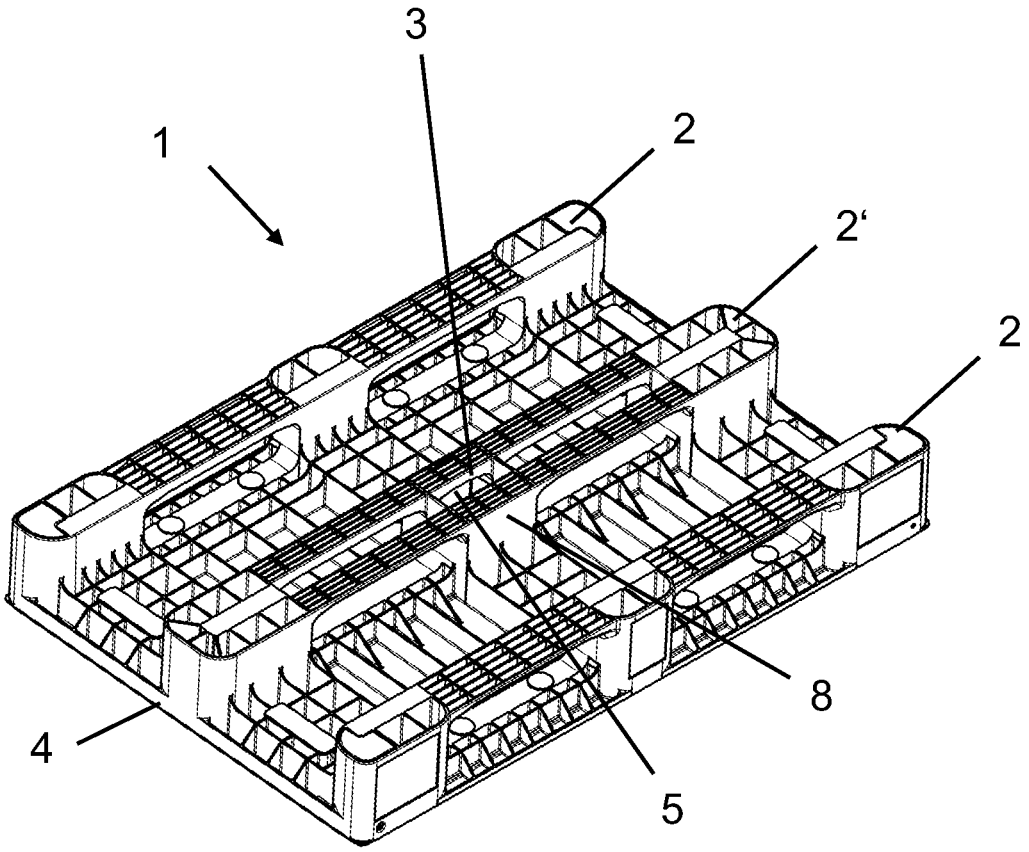
FIG. 12 shows the plastic pallet with a further variant of the handle in perspective view from below.

FIG. 12 shows another variant of a plastic pallet 1 having three skids 2, 2', wherein the central skid 2' has an opening along the middle of the central skid 2' to two cavities 5 for fingers. The central skid 2' has two symmetrically arranged handles 3 in the area of the opening and on the lower side along the two longitudinal sides of the central skid 2'. The opening and the cavities 5 eable the two symmetrical handles 3.

The cavities 5 for fingers extend parallel to the lower side of the central skid 2' and are formed at a distance from the lower side of the central skid 2' against the side walls 8 of the central skid 2'. The side walls 8 are closed in the middle area of the central skid 2'. This variant is particularly suitable for smaller people who can reach with their fingers from the middle of the central skid 2' against the side wall 8 of the central skid 2'.

Although various embodiments of the present invention have been described and shown, the invention is not restricted thereto, but may also be embodied in other ways within the scope of the subject-matter defined in the following claims.

What is claimed is:

1. A plastic pallet comprising: a lower side provided with skids and an opposite upper side, one of the skids at the lower side being a central skid extending along the center of the plastic pallet, and having an opening with an elongated handle which can be gripped with one hand from the lower side of the pallet, the opening with the elongated handle being arranged in the middle of the longitudinal and transverse extension of the central skid, such that the elongated handle is located in the region of the geometric center of the pallet.

2. The plastic pallet according to claim 1, wherein the upper side of the pallet has a continuously closed surface.

3. The plastic pallet according to claim 2, wherein the handle is aligned along the center of the central longitudinal axis of the skid.

4. The plastic pallet according to claim 2, wherein a cavity for fingers is provided between the handle and the upper side of the plastic pallet.

5. The plastic pallet according to claim 2, wherein the central skid has an opening in its lower surface along its center leading to a cavity for fingers.

6. The plastic pallet according to claim 1, wherein the elongated handle is aligned parallel to the surface of the upper side of the pallet.

7. The plastic pallet according to claim 6, wherein a cavity for fingers is provided between the handle and the upper side of the plastic pallet.

8. The plastic pallet according to claim 7, wherein the handle is aligned along the center of the central longitudinal axis of the skid.

9. The plastic pallet according to claim 6, wherein the central skid has an opening in its lower surface along its center leading to a cavity for fingers.

10. The plastic pallet according to claim 1, wherein the handle is aligned along the center of the central longitudinal axis of the skid.

11. The plastic pallet according to claim 10, wherein a cavity for fingers is provided between the handle and the upper side of the plastic pallet.

12. The plastic pallet according to claim 1, wherein the central skid has the opening in its lower surface along its center leading to a cavity for fingers.

13. The plastic pallet according to claim 1, wherein the lower surface of the central skid is continuous and the opening is provided in a side wall of the central skid.

14. The plastic pallet according to claim 13, wherein a cavity for fingers is provided between the handle and the upper side of the plastic pallet.

15. The plastic pallet according to claim 1, wherein the elongated handle is oriented perpendicular to the surface of the upper side.

* * * * *